US010086984B2

(12) United States Patent
Colangelo

(10) Patent No.: US 10,086,984 B2
(45) Date of Patent: Oct. 2, 2018

(54) MOLDED CONTAINER WITH OPENER AND METHOD FOR USE

(75) Inventor: Kevin Colin Colangelo, Fox Lake, IL (US)

(73) Assignee: R.P. SCHERER TECHNOLOGIES, LLC, Las Vegas, NV (US)

( * ) Notice: Subject to any disclaimer, the term of this patent is extended or adjusted under 35 U.S.C. 154(b) by 0 days.

(21) Appl. No.: 12/494,873

(22) Filed: Jun. 30, 2009

(65) Prior Publication Data

US 2010/0326022 A1 Dec. 30, 2010

(51) Int. Cl.

| | |
|---|---|
| ***B65D 51/00*** | (2006.01) |
| ***A61J 1/14*** | (2006.01) |
| ***B65D 1/02*** | (2006.01) |
| ***B65D 47/36*** | (2006.01) |
| ***B65D 39/06*** | (2006.01) |

(52) U.S. Cl.

CPC ..... *B65D 51/002* (2013.01); *A61J 1/1412* (2013.01); *B65D 1/0238* (2013.01); *B65D 1/0253* (2013.01); *B65D 39/06* (2013.01); *B65D 47/36* (2013.01)

(58) Field of Classification Search

CPC ..... A65J 2001/2027; B65D 1/0253; B65D 47/36; B65D 51/002; B65D 1/0238; B65D 39/06; A61J 1/1412

USPC ..... 215/247, 249, 253, 255, 274, 280, 305; 220/319; 604/415

See application file for complete search history.

(56) References Cited

U.S. PATENT DOCUMENTS

| | | | | |
|---|---|---|---|---|
| 832,452 | A | | 10/1906 | Bloom |
| 3,379,326 | A | * | 4/1968 | Anderson ..... 215/249 |
| 3,480,171 | A | | 11/1969 | Rohde |
| 3,902,619 | A | | 9/1975 | Gouget |
| 4,176,756 | A | * | 12/1979 | Gellman ..... 215/274 |
| 4,226,334 | A | | 10/1980 | Weiler et al. |

(Continued)

FOREIGN PATENT DOCUMENTS

| | | | |
|---|---|---|---|
| CN | 2827922 | Y | 10/2006 |
| FR | 2239388 | A2 | 2/1975 |

(Continued)

OTHER PUBLICATIONS

Japanese Office Action issued in counterpart application No. 2010-147466 dated Mar. 31, 2014, along with its English-language translation—6 pages.

(Continued)

*Primary Examiner* — James N Smalley

(74) *Attorney, Agent, or Firm* — Fitzpatrick, Cella, Harper & Scinto

(57) ABSTRACT

A fluid container is provided that comprises a body portion configured to at least partially surround fluid. The container also includes a cap portion connected to and above the body portion at a frangible separation site surrounding an opening between the body portion and the cap portion. The cap portion is configured to separate from the body portion at the separation site to expose the opening when a substantially downwardly directed force is applied to a part of the cap portion at a certain radial distance from a longitudinal axis through the opening. The container can include a collar configured to be disposed at least around a part of the body portion. A portion of the collar can be configured to facilitate separation of the cap portion.

18 Claims, 10 Drawing Sheets

(56) References Cited

U.S. PATENT DOCUMENTS

| | | | | |
|---|---|---|---|---|
| 4,241,188 | A * | 12/1980 | Materia et al. | 435/304.1 |
| 4,274,543 | A | 6/1981 | Braymer et al. | |
| 4,353,869 | A * | 10/1982 | Guth | 422/558 |
| 4,403,707 | A * | 9/1983 | Connor | 215/253 |
| 4,456,200 | A | 6/1984 | Ariniello | |
| 4,746,017 | A | 5/1988 | Howard et al. | |
| 5,114,030 | A * | 5/1992 | Conard | 215/249 |
| 5,316,163 | A | 5/1994 | von Schuckmann | |
| 5,636,756 | A * | 6/1997 | Johnson | 215/206 |
| 5,718,346 | A | 2/1998 | Weiler | |
| 5,878,900 | A * | 3/1999 | Hansen | 215/50 |
| 6,098,256 | A * | 8/2000 | Poussard | 24/704.1 |
| 6,244,487 | B1 * | 6/2001 | Murray | 225/93 |
| 6,543,655 | B1 | 4/2003 | de Laforcade | |
| 6,571,971 | B1 | 6/2003 | Weiler | |
| 7,735,667 | B2 * | 6/2010 | Schutz | 215/276 |
| 7,804,405 | B2 * | 9/2010 | Norman et al. | 340/572.1 |
| 2006/0070999 | A1 * | 4/2006 | Stull | B65D 47/10 220/257.2 |
| 2006/0118507 | A1 * | 6/2006 | Feldman | 215/12.1 |
| 2007/0007230 | A1 * | 1/2007 | Kim | 215/253 |
| 2008/0083691 | A1 * | 4/2008 | Poynter et al. | 215/6 |
| 2009/0054865 | A1 * | 2/2009 | Brandenburger et al. | 604/415 |

FOREIGN PATENT DOCUMENTS

| | | | |
|---|---|---|---|
| JP | S49-15573 | B | 4/1974 |
| JP | H05-076436 | U | 10/1993 |
| JP | 2004-269060 | A | 9/2004 |
| JP | 2007223658 | A | 9/2007 |
| WO | 2008042939 | A2 | 4/2008 |

OTHER PUBLICATIONS

Japanese Office Action issued in counterpart No. 2010-147466, dated Sep. 14, 2015 (10 pages).
Japanese Decision of Appeal issued in counterpart No. 2010-147466, dated Aug. 1, 2016 (37 pages).
Chinese Office Action issued in counterpart No. 201010220957.9, dated Dec. 23, 2013 (33 pages).
Chinese Office Action issued in counterpart No. 201010220957.9, dated Sep. 3, 2014 (36 pages).
Chinese Office Action issued in counterpart No. 201010220957.9, dated Mar. 2, 2015 (7 pages).
Chinese Notice to Grant issued in counterpart No. 201010220957.9, dated Oct. 10, 2015 (4 pages).
Canadian Office Action issued in counterpart No. 2,708,586, dated Jan. 30, 2013 (4 pages).
Canadian Office Action issued in counterpart No. 2,708,586, dated Apr. 1, 2014 (2 pages).
Canadian Office Action issued in counterpart No. 2,708,586, dated Apr. 7, 2015 (5 pages).
Canadian Notice of Allowance issued in counterpart No. 2,708,586, dated Apr. 8, 2016 (1 page).
European Search Report issued in counterpart No. 10167981.9, dated Aug. 13, 2010 (6 pages).
European Office Action issued in counterpart No. 10167981.9, dated Sep. 23, 2011 (4 pages).
European Office Action issued in counterpart No. 10167981.9, dated Jul. 24, 2012 (5 pages).
European Office Action issued in counterpart No. 10167981.9, dated Apr. 23, 2015 (5 pages).
European Intention to Grant issued in counterpart No. 10167981.9, dated Mar. 15, 2016 (10 pages).

* cited by examiner

MOLDED CONTAINER WITH OPENER AND METHOD FOR USE

TECHNICAL FIELD

The invention relates to improvements for opening sealed containers, including molded containers, such as a blow-fill-seal (BFS) vial containing an internal elastomeric stopper that partially protrudes beyond an opening of the vial when the vial is opened.

BACKGROUND OF THE INVENTION

Field of the Invention

Molded containers, BFS containers, and vials with encapsulated stoppers are described in U.S. patent application Ser. No. 11/542,869, filed Oct. 4, 2006, and published as U.S. Pat. Appln. Pub. 2008/0083691 on Apr. 10, 2008, the entire contents of which are incorporated herein by reference. FIGS. 3-14*b* of the '869 application show various embodiments of portions of containers that can be molded with an engineered separation site.

As shown in FIGS. 13*a*-*b* and 14*a*-*b*, of the '869 application, to assist in the separation of the cap portion 300 from the body portion, the cap portion 300 (FIG. 7), may have a cap portion wall 320 formed with a grip enhancing feature 330. Such a grip enhancing feature 330 may be a flattened tab 332 having a lateral aspect 333, such as is shown in FIGS. 13*a*-*b* and 14*a*-*b*, which permits the use of two hands to separate the cap portion from the body portion; one hand to grip the body portion 200 and another hand to twist off the cap portion 300. Such a twisting motion is shown in FIG. 13*b* by the two-headed arrow indicating rotation that is shown on the cap portion 300. Another embodiment of the container in the '869 application is shown in FIG. 14*b*. According to the '047 application, the configuration of the tab 332 allows easier removal of the cap portion 300 from the body portion 200 by simply torquing the cap portion 300, in the direction shown by the single headed arrow on the cap portion 300. While one-handed removal of the cap portion 300 in such embodiments is not impossible, it may require a degree of hand strength not universally found among those desiring to use the container 10.

In the case of one hand opening of the container shown in FIG. 14*b* of the '869 application, a force applied to the tab 332 in the direction of the arrow may result in a portion of the hand of the user contacting, and contaminating, the raised nipple 130 after the incipient separation of the cap portion 300 from the body portion 200 due to continued motion of the portion of the hand (e.g., finger) in contact with the tab 332 in an inwardly radial direction.

SUMMARY OF THE INVENTION

In its most general configuration, the present invention advances the state of the art with a variety of new capabilities and overcomes many of the shortcomings of prior devices in new and novel ways. In addition to reducing the hand strength required for one hand opening of a molded container, it is also preferable to also reduce the likelihood of a user contaminating an opening in the container resulting from opening the container or any structure extending from such opening, such as when opening the container using the hands of a user.

In a first aspect of the invention in a container for providing access to a raised nipple upon opening, the container having at least one diameter and a longitudinal axis, an improvement is provided. The container includes a container shell comprising a body portion with a body portion wall having a wall shoulder portion having a distal aspect and a proximal aspect. The container also includes an adjoining cap portion having a cap portion wall. The body portion wall meets the cap portion wall at an engineered separation site. The container also includes a stopper enclosed within the container shell and prevents the transfer of contents from the body portion to the cap portion, such that a portion of the stopper is enclosed within the body portion and a portion of the stopper is enclosed within the cap portion, wherein the stopper has a stopper wall and a stopper shoulder with a central raised nipple having a nipple top surface with an injection site bounded by a raised injection guide and a nipple sidewall. The engineered separation site is adjacent to the nipple sidewall such that when the cap portion is removed from the body portion at the engineered separation site a portion of the nipple extends out of the body portion. The improvement includes an opener attached to the container that is configured to separate the cap portion from the body portion at the separation site by receiving and transferring a downwardly directed force to the cap portion at a certain radial distance from the longitudinal axis.

The container may also include a collar disposed at least around the wall shoulder portion, and the collar can be removable. The collar can extend from a first opening surrounding the separation site to a second opening surrounding a neck formed in the body portion below an annular flange formed in the body portion. The collar can include at least a pair of semicircular annular channels hingedly connected to each other at respective ends thereof, the channels having free ends configured to be connected together to close the collar around the wall shoulder portion. The annular channels can be configured to secure the collar to the body portion when the collar is closed around the wall shoulder portion. Each of the free ends of the pair of annular channels include corresponding mating fasteners to secure the free ends together to close the collar. The collar can display indicia related to the contents of the container. For example, the collar may display a color. A portion of the collar can be configured to act as a fulcrum for the at least one tab.

In a second aspect of the invention a fluid container is provided that includes a fluid container including a body portion configured to at least partially surround fluid. The fluid container also includes a cap portion connected to and above the body portion at a frangible separation site surrounding an opening. The cap portion is configured to separate from the body at the separation site to expose the opening when a substantially downwardly directed force is applied to a portion of the cap portion at a certain radial distance from a longitudinal axis through the opening.

In a third aspect of the invention a method of opening a fluid container is provided that includes providing the fluid container and applying a predetermined downwardly directed force to a portion of the container. The method includes providing the container and applying a predetermined downwardly directed force. The fluid container is comprised of a body portion and a cap portion. The body portion is configured to at least partially surround fluid. The cap portion is connected to and above the body portion at a frangible separation site surrounding an opening, wherein the cap portion is configured to separate from the body at the separation site to expose the opening when a substantially downwardly directed force is applied to a portion of the cap portion at a certain radial distance from a longitudinal axis through the opening. The method also includes applying the predetermined downwardly directed force to a portion of the cap portion at a certain radial distance from a longitudinal axis passing through the nipple.

The downwardly directed force is applied at a certain radial distance generates a torque about an axis substantially orthogonal to the longitudinal axis. A sufficient torque is generated to separate the cap portion from the body portion at the separation site. The predetermined force can be applied to at least one tab formed in the cap portion extending radially outwardly therefrom. The predetermined force can be applied using at least a portion of a hand of a user, and can include at least one of a thumb, a digit, and a palm. The method may also include grasping the container by the hand of the user.

BRIEF DESCRIPTION OF THE DRAWINGS

Without limiting the scope of the present invention as claimed below and referring now to the drawings and figures, all not to scale:

DETAILED DESCRIPTION OF THE INVENTION

Figure 1:
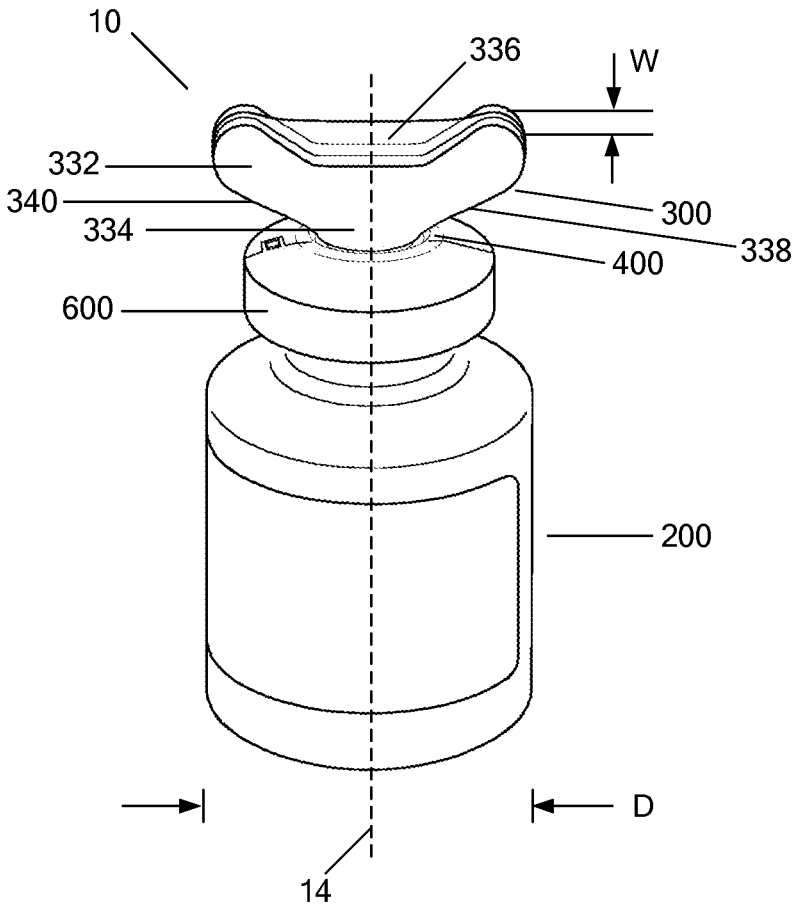
FIG. 1 is a perspective view of an embodiment of a container and optional collar in accordance with an aspect of the invention.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

The opening feature of the present invention is preferably used in conjunction with molded containers, and more preferably with BFS molded containers having features arranged similar to those shown in FIGS. 3-14*b* of the '869 application. Accordingly, the opening feature described herein can be used as a modification of the designs shown in FIGS. 3-14*b* of the '869 application and can be used for other sealed molded containers, as will be appreciated by one of skill in the art.

In one embodiment the container 10 includes a body portion 200, and a cap portion 300. The container may also include a stopper 100, shown in FIGS. 3-5. The cap portion 300 includes at least one tab 332 that facilitates the separation of the cap portion 300 from the body portion 200 at a separation site 400 using at least one hand. The configuration of the separation site 400 will be described in greater detail below. In particular, the tabs 332 of the cap portion 300 extend substantially radially outwardly from a longitudinal axis 14 of the container 10 passing through an opening defined by the separation site 400. The tabs 332 are configured to separate the cap portion 300 from the body portion 200 at the separation site 400 upon the exertion of a downward directed force to at least a portion of one of the tabs 332 at a certain radial distance away from the longitudinal axis 14 of the container.

As shown in FIG. 1 the cap portion 300 is preferably formed having a generally Y-shaped or T-shaped profile having a central portion 334 connected to the separation site 400 and a pair of radially extending tabs 332 extending from an upper part of the central portion 334. The tabs 332 and the central portion 334 are preferably coplanar having a width W, which preferably provides sufficient surface area on the top side of the tab 332 to apply pressure with at least one finger of the user. Ribs or gussets 336 may be formed, between each of the tabs 332 at the upper side of the cap portion 300 and between each of the tabs 332 and the central portion 334 along lateral sides 338, 340. Such gussets or ribs 336 further stiffen the cap portion 300 to withstand deformation (e.g., bending or compressing) of the tabs 332 and/or the central portion 334 when a force is applied to the tabs 332 to open the container 10, as shown in FIG. 2.

The tabs 332 extend upwardly at an angle with respect to longitudinal axis 14, that angle is preferably acute. Each tab 332 is preferably configured to extend radially outwardly beyond the diameter of the separation site 400, but is less than or equal to the diameter D of the body portion 200. The tabs 332 are preferably configured to receive at least a portion of a finger of a user, such as a thumb or index finger. The tabs 332 may include a portion that is configured to receive and concentrate an applied downward force at a certain radial distance, such as the radially outermost point on the tab 332, from the longitudinal axis 14. As shown in FIG. 2, the upper surface of the cap portion 300 between the tabs 332 is preferably configured as a concave surface to receive a finger tip. Moreover, the portion of the tab 332 configured to receive the downwardly directed force may be textured, such as to include raised dimples and/or grooves, to limit slippage between the user's finger and the tab 332. It should be noted that while symmetrical tabs 332 are shown in FIGS. 1-5, in other embodiments, the cap portion 300 may be configured with more or fewer tabs 332, which may or may not be symmetrical. Moreover, in other embodiments (not shown), the tabs 332 may be substituted with other structures, such as a planar or bowl shaped disk or frustoconical surface connected to the central portion 334 of the cap portion 300.

The container 10 is preferably formed from a material, such as polypropylene, that is sufficiently stiff throughout the container, with the exception of the frangible sealing site 400, to at least withstand the application of forces imparted to the container 10 from manipulation by hands and fingers of the user.

Figure 2:
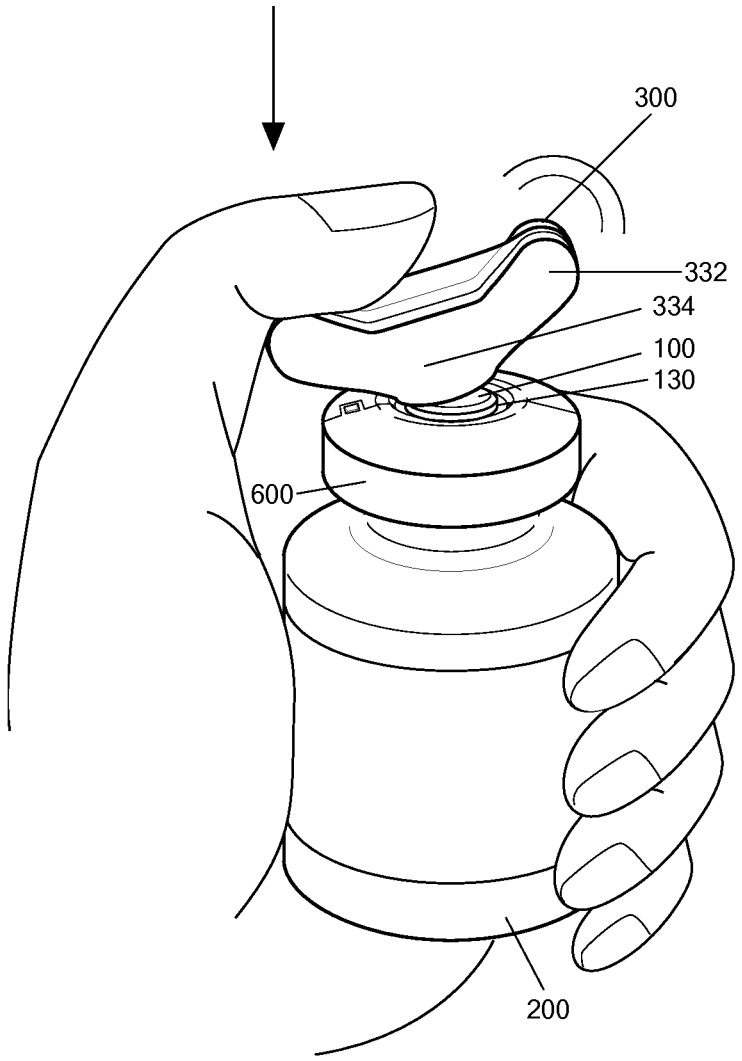
FIG. 2 is a perspective view of the container shown in FIG. 1 being opened using a hand of the user in accordance with an aspect of the invention.

FIG. 2 shows the application of a downward directed force applied by a thumb on a tab 322 of the cap portion 300 causing partial separation of the cap portion 300 from the body portion 200 at the separation site 400. In the case of one hand opening, a user, for example, can grasp the body portion 200 of the container 10 between the four digits and palm of the hand so as to position the thumb of the hand above the tab 332 such that the path of travel of the thumb is downward toward the tab 332. Preferably, the force is applied to a radially outer end of the tab 332. Where the container 10 includes the optional collar 600, the upper surface of the collar 600 is configured to contact the tab 332 proximate to the separation site 400 so as to act as a fulcrum to further assist in providing leverage to separate the cap portion 300 from the body portion 200. The cap portion 300 is configured to separate from the body portion 200 at the separation site 400 when a sufficient torque is applied to the cap portion 300 as a result of the downward directed force applied at one of the tabs 332 of the cap portion 300.

The ability to open the container 10 by applying downward force to a portion of the cap portion 300, such as, for example, by applying pressure with a thumb to the tab 332 shown in FIG. 2, facilitates removal of the cap portion 300 using only a single hand by requiring less manual dexterity and hand strength than is required for opening conventional molded containers. Moreover, applying downward pressure using a thumb is particularly advantageous because all of the remaining four digits of the hand can be grasped around the longitudinally extending body of the container while the cap portion 300 is separated from the body portion 200, reducing the likelihood that those four digits of the hand are either near a nipple 130 of the optional stopper 100 after removal of the cap portion 300 or are in motion towards the nipple 130 after the incipient separation of the cap portion 300, to avoid inadvertent contact of the user's hand with the exposed nipple. Gripping the container 10 in the palm of the hand as shown in FIG. 2, with at least some of digits grasped around the body portion 200 of the container 10 also establishes a path of travel of the thumb in a substantially downward direction in order to maximize the mechanical leverage acting on the tab 332.

Figure 3:
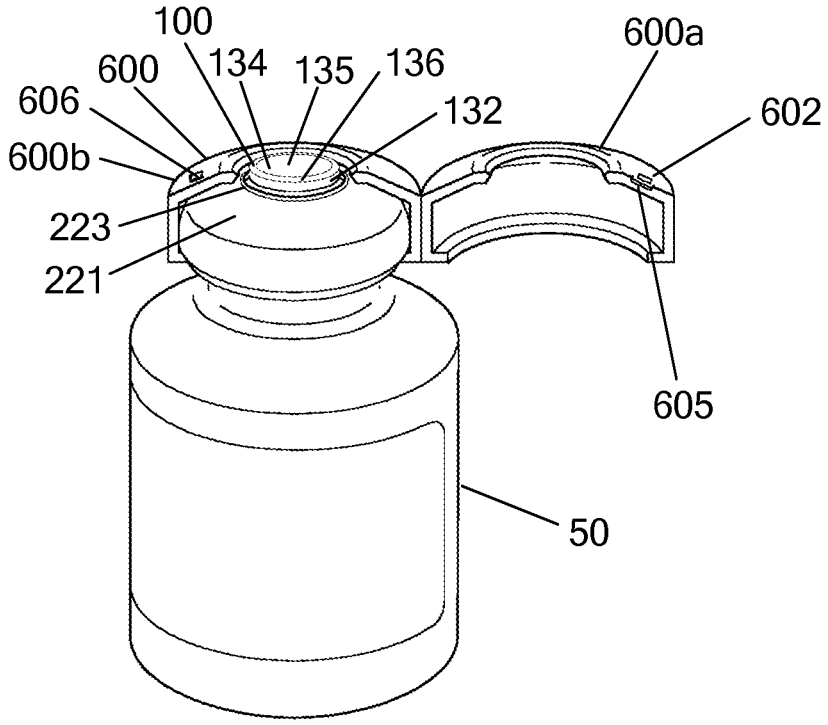
FIG. 3 is a perspective view of a portion of the container shown in FIGS. 1 and 2 with a cap portion removed and the collar opened.
Figure 4:
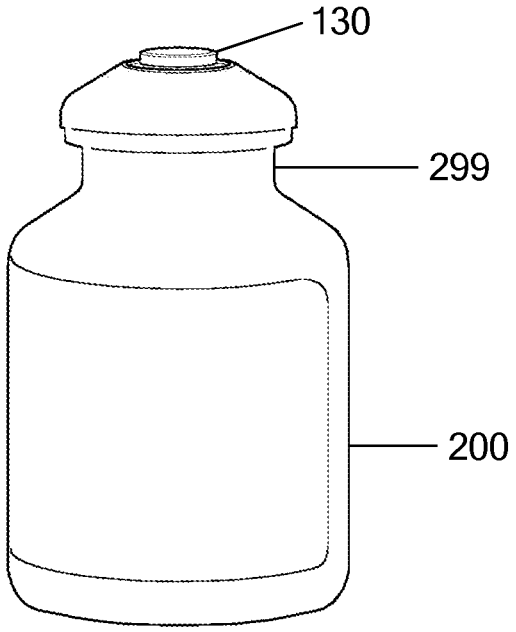
FIG. 4 is a perspective view of a portion of the container shown in FIGS. 1-3 shown with the collar removed.

The collar 600 may be configured to be removable from the container 10. FIG. 3 shows a portion of the container 10 with the cap portion 300 removed and the top surface 134 of the nipple 130 fully exposed and the collar 600 partially removed. FIG. 4 shows the container without the collar 600 or the cap portion 300. The collar 600 is shown in FIG. 3 in a partially removed and open condition. The collar 600 may be formed from a plastic and preferably displays a color or other indicia, to denote, for example, the contents of the container 10.

The collar 600 shown in FIGS. 1-3 includes two semi-circular annular channel portions, 600*a* and 600*b*, that are each hingedly connected to each other at an attached end. Each of the two portions 600*a* and 600*b* have an inner annular profile that is generally a c- or u-shaped channel that is configured to cooperate with the outer surface of the body portion 200 surrounding the stopper 100. The two portions, 600*a* and 600*b*, are configured to close toward each other around and be retained at least by a wall shoulder portion 221 of the body portion 200. Each of the annular portions 600*a* and 600*b* has a free end, diametrically opposite its respective attached end, having a closure configured to secure the free ends together. For example, the free end of a first portion 600*a* includes a male tab 605 extending circumferentially from an upper edge of the free end of the first portion 600*a*, which is configured to mate with a corresponding female aperture 606 formed through the upper surface of the second portion 600*b* proximate to an upper edge at the free end of the second portion 600*b*. The male tab 605 is configured to cooperate with the female aperture 606 during closing and opening of the collar 600, such as by snap-fit connection. The male tab 605 may be a resilient member which can be displaced a sufficient amount during opening and closing of the first and second portions, 600*a* and 600*b*, respectively, of the collar 600.

Figure 5:
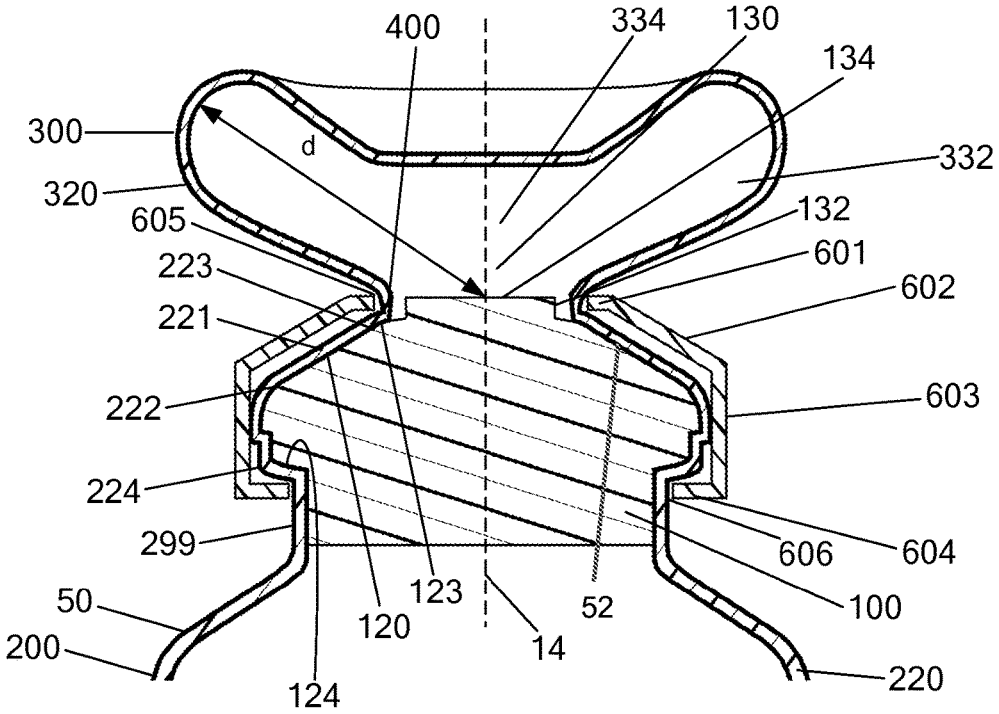
FIG. 5 is a cross section view of a part of the container shown in FIGS. 1 and 2.

As shown in greater detail in the cross section shown in FIG. 5, the collar 600 is configured to have an inner annular profile that extends substantially around a wall shoulder portion 221 of the body portion 200 from a proximal aspect 223 to a distal aspect 222 and around an ingress preventer 224. The terms "distal" and proximal" are intended to represent positions relatively farther and relatively nearer, respectively, from the longitudinal axis 14 of the container 10.

The collar 600 has a first annular upper surface 601, substantially perpendicular to the longitudinal axis 14 of the container 10. The first annular upper surface 601 is defined by an inner diameter surrounding a first opening 605 of the collar 600 and an outer diameter, near the proximal aspect 223 of the wall shoulder portion 221. The first opening 605 is configured to surround the separation site 400. The first annular surface 601 is preferably configured to articulate with at least one of the lateral sides 340, 338 (FIG. 1) of the tabs 332 during opening of the container 10 to act as a fulcrum. A second annular surface 602 extends radially outwardly in a frustoconical shape from the outer diameter of the first annular surface 601. The second annular surface 602 has an outer diameter that extends substantially to the distal aspect 222 of the wall shoulder portion 221. A third annular surface 603 extends from the outer diameter of the second annular surface 602 in substantially a downward direction, parallel to the longitudinal axis of the container 10. The third annular surface 603 extends downward toward an annular flange formed by the ingress preventer 224. A fourth annular surface 604 extends from a lower edge of the third annular surface 603 radially inwardly to define a second opening 606 surrounding a neck 299 of the body portion 200 below the ingress preventer 224. The fourth annular surface 604 is substantially parallel to the first annular surface 601.

Clean and accurate removal of the cap portion 300 from the body portion 200 may also be facilitated by refinements in the engineered separation site 400 where the body portion wall 220 meets the cap portion wall 320. Such a site 400 could comprise, by way of example, a score line in the shell wall 52. In one embodiment of the instant invention, as seen in FIGS. 4 and 5, the engineered separation site 400 comprises a line of discontinuity in shell thickness between the body portion wall 220 and the cap portion wall 320. The discontinuity creates a natural fracture zone between the adjoining body portion 200 and cap portion 300. As seen in FIG. 5, in a further embodiment, the engineered separation site 400 is formed by a progressive attenuation of the thickness of the wall shoulder portion 221, see FIG. 5, tapering from a maximum thickness at the distal aspect 222 of the wall shoulder portion 221 to reach a minimum thickness at the proximal aspect 223 of the wall shoulder portion 221.

The radial length of the tab 332 of the cap portion 300 can affect one hand separation of the cap portion 300 from the body portion 200. If the length of the tab 332 is too small, given the hand strength of the user, the torque produced may be insufficient to initiate breakage at the engineered separation site 400. Further, the hand strength required for one-handed opening may be decreased by increasing the length of the tab 332. That is, the larger the tab 332 relative to the width of the container 10, the less force that must be applied at a distal point on the tab 332 to effect a rupture at the engineered separation site 400. However, if the tab 332 is too long, the cap portion 300 may be accidentally separated from the body 200 by inadvertent contact with the tab 332. Preferably, the tab extends radially between the diameter of the fracture site 400 and the diameter D of the body portion 200 of the container.

Some of the features of an exemplary container 10 having the optional electronic stopper 100 will now be described in greater detail with reference to FIGS. 3 and 5.

As shown in FIGS. 3 and 5, the container has a container shell 50 comprising a body portion 200 with a body portion wall 220 having a wall shoulder portion 221 having a distal aspect 222 and a proximal aspect 223, best seen in FIG. 5. The body portion 200 has an adjoining cap portion 300, having a cap portion wall 320, and the body portion wall 220 meets the cap portion wall 320 at an engineered separation site 400. The engineered separation site 400 is designed to represent an area of weakness in the walls 220, 320 of the container, such that a uniform and repeatable breakage area is created for the removal of the cap portion 300 from the body portion 200.

The container 10 preferably has stopper 100 enclosed within the container shell 50 that prevents the transfer of contents from the body portion 200 to the cap portion 300. A portion of the stopper 100 is enclosed within the body portion 200 and a portion of the stopper 100 is enclosed within the cap portion 300. The stopper 100 has a stopper wall 120 and a stopper shoulder 123 (FIG. 5), with a central raised nipple 130 having a nipple top surface 134 with an injection site 135 and a nipple sidewall 132. The engineered separation site 400, is adjacent to the nipple sidewall 132 such that when the cap portion 300 is removed from the body portion 200 at the engineered separation site 400 a portion of the nipple 130 extends out of the body portion 200, as shown in FIGS. 3-5. Additionally, in some embodiments, the injection site 135 on the top surface 134 of the nipple 130 is bounded by a raised injection guide 136 (FIGS. 2 and 3) to assist in correct placement of a needle or other removal means into the stopper 100.

As shown in FIG. 5, the body wall shoulder portion 221, adjacent to the cap portion 300, may be configured at a non-orthogonal angle from the longitudinal axis 14 of the container 10.

The container may also be configured so that the body portion wall 220 has an ingress preventer 224 (FIG. 5), wherein the ingress preventer 224 cooperates with a stopper ingress preventer 124 formed in the stopper wall 120. Such cooperation decreases the likelihood that the stopper 100 can be inadvertently forced into the container 10 by external pressure.

Other embodiments of body portion 200 and stopper 100 can be used with the opening arrangement of the invention. In an embodiment of a container shown in FIG. 5 of the '869 application, a wall retention surface 226 on the body portion wall 220 cooperates with a stopper retention surface 126 on the stopper wall 120. By way of example only, such cooperation may provide sufficient frictional fit so that the stopper 100 is less likely to be forced into, or expelled from, the container 10. The container shown in FIG. 5 of the '869 application, shows the wall retention surface 226 further comprises at least one wall egress preventer 227, wherein the wall egress preventer 227 cooperates with a stopper egress preventer 127 on the stopper retention surface 126.

In the embodiment shown in FIG. 5, the tab 332 is formed such that a distance d from a most distant point on the tab 332 from a center of the injection site 135 is at least 50% of the largest of the at least one diameter D of the container 10. In a further embodiment, the tab 332 is formed such that a distance d is at least 65% of the largest of the at least one diameter D of the container 10.

Figure 7A:
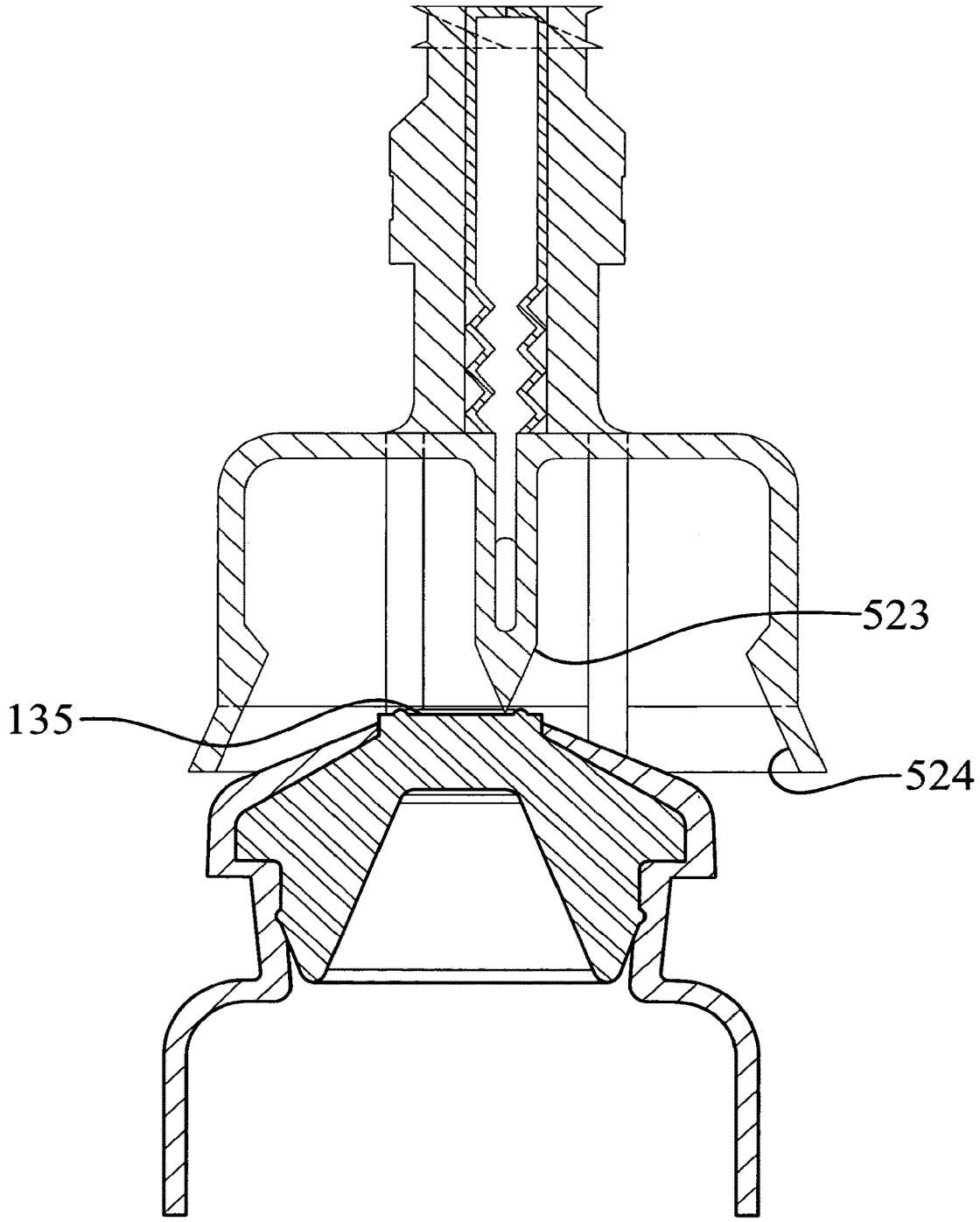
FIG. 7*a* is a cross section view showing potential misalignment between the body portion of the embodiment of FIG. 5, and a needle-free connector.
Figure 7B:
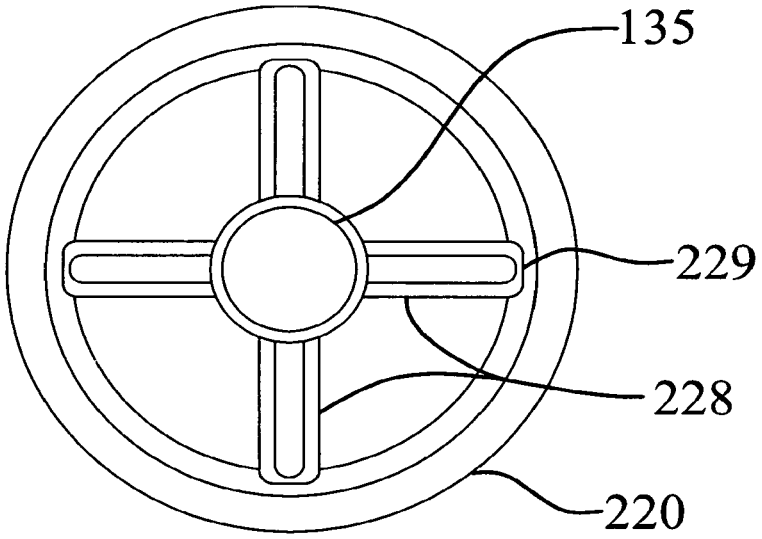
FIG. 7*b* is a top plan view of an embodiment of the instant invention, showing raised gussets extending from a wall shoulder portion.
Figure 8:
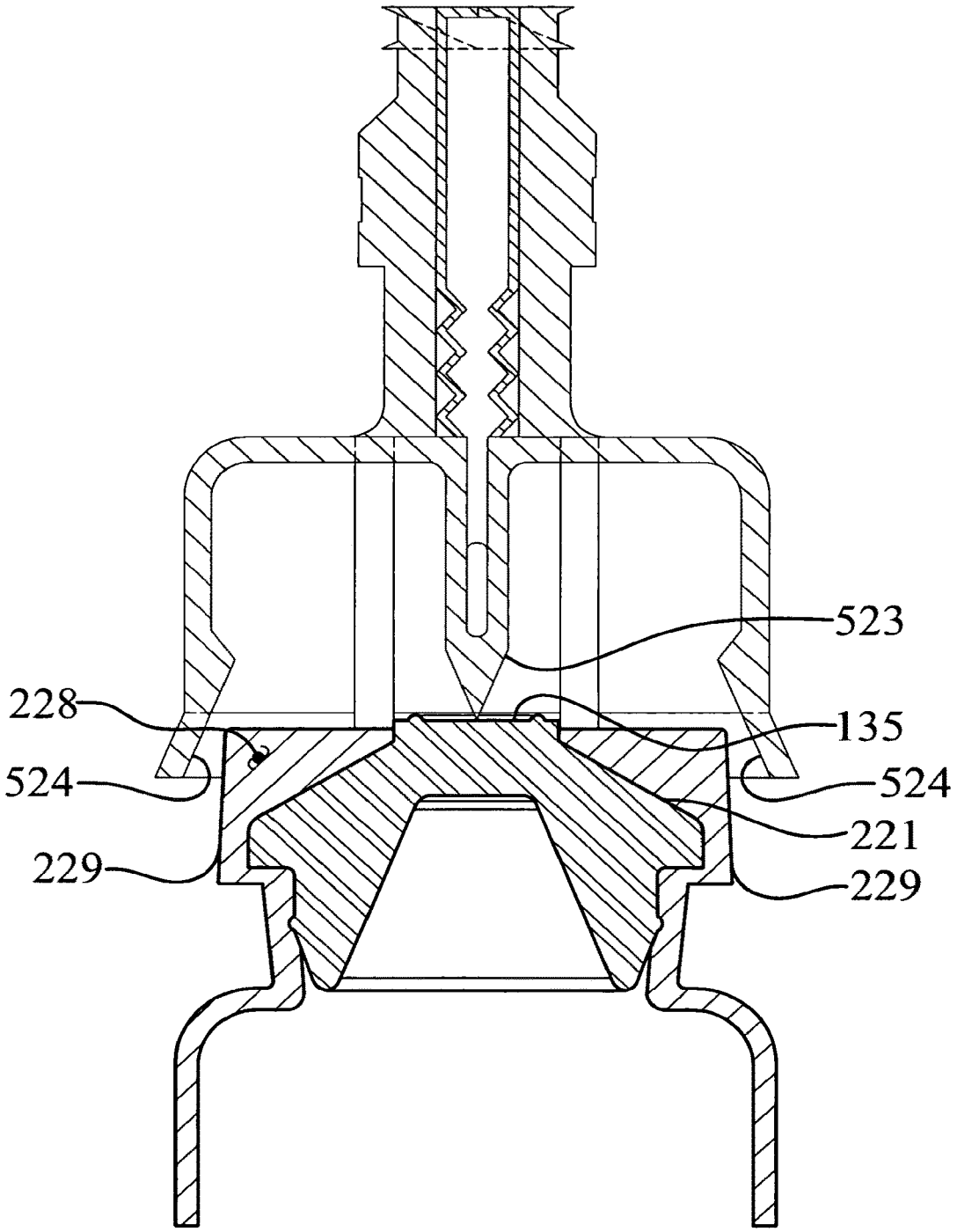
FIG. 8 is a cross section view of a part of the body portion of the BFS vial and a needle-free connector.

In another embodiment, the wall shoulder portion 221 further comprises at least one raised gusset 228, seen in FIGS. 7*b* and 8, extending from the wall shoulder portion 221 and having a lateral surface 229 substantially parallel to the longitudinal axis 14 of the container 10. Such gusset(s) 228 not only tend to strengthen the BFS vial, but may cooperate with a variety of needle-free connectors, such as, by way of example only, the SMARTSITE® needle-free connector manufactured by Cardinal Health, Inc. of Dublin, Ohio, USA.

Figure 9:
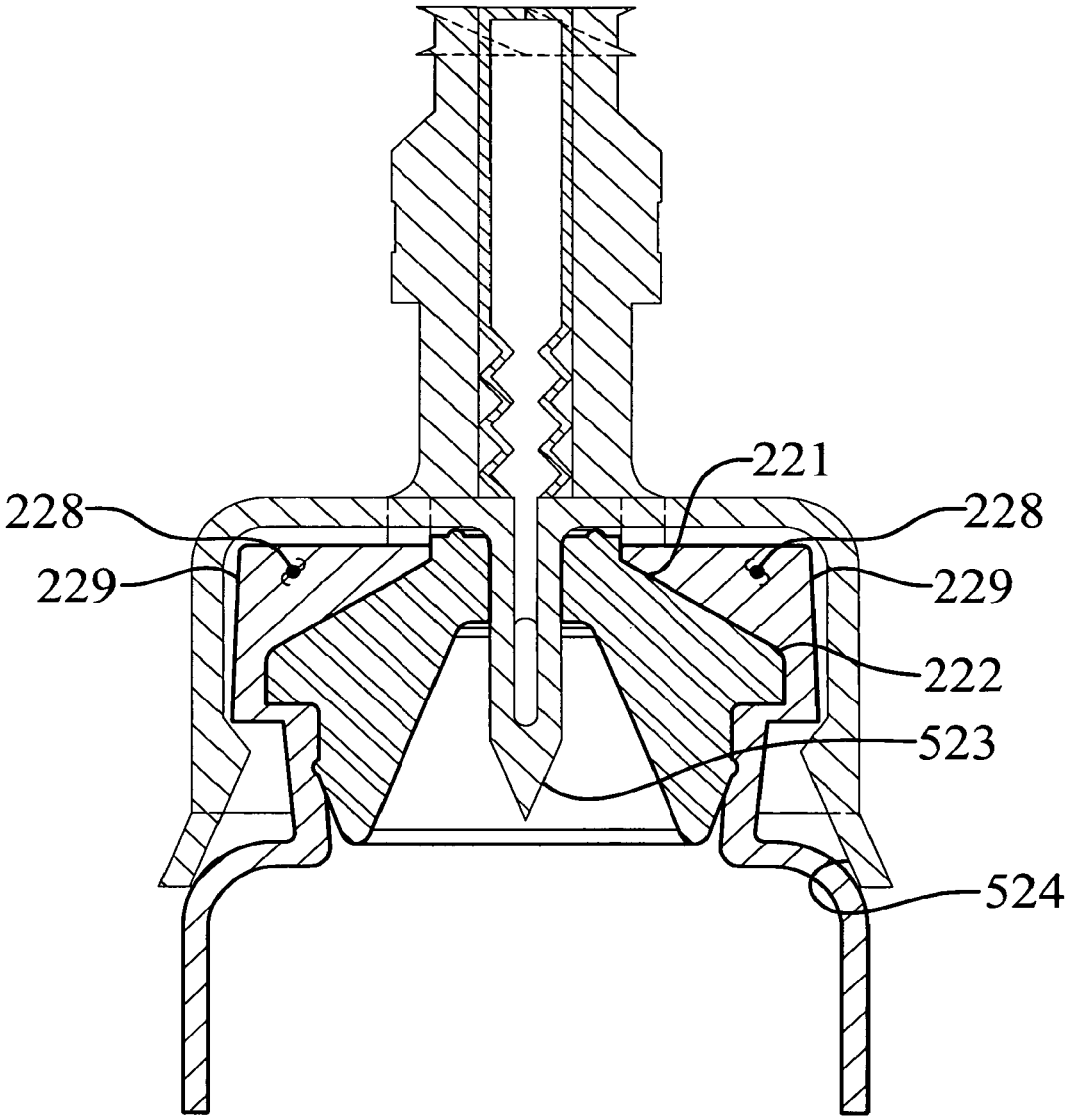
FIG. 9 is a cross section view of a part of the body portion of the embodiment of the instant invention with the needle-free connector inserted.
Figure 10A:
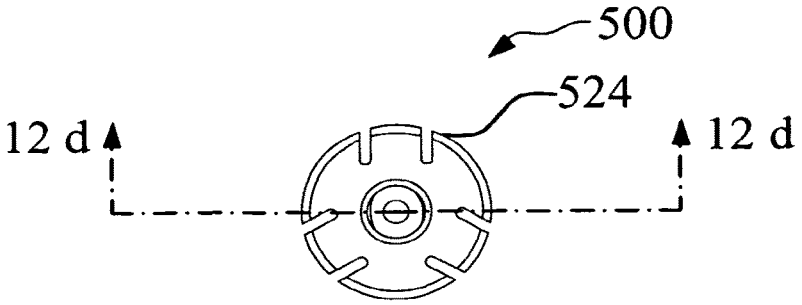
FIG. 10*a* is a top plan view of a prior art needle-free connector suitable for use with the instant invention.
Figure 10B:
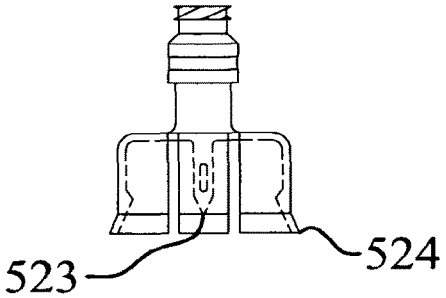
FIG. 10*b* is a side elevation view of a prior art needle-free connector suitable for use with the instant invention.
Figure 10C:
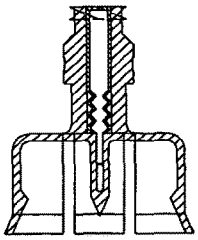
FIG. 10*c* is a bottom plan view of a prior art needle-free connector suitable for use with the instant invention.
Figure 10D:
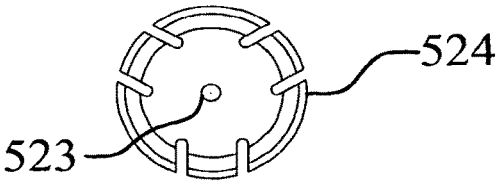
FIG. 10*d* is a cross section view of a prior art needle-free connector suitable for use with the instant invention.

Extending the length of the lateral surface 229, see FIG. 7*b*, increases the surface area of interaction between the lateral surface 229 and the interior surface of a needle-free container, as can be seen in FIGS. 8 and 9. A larger surface area for interaction results in a more stable cooperation between the elements and a more positive centering of a needle-free connector, as will be discussed immediately below in relationship to FIGS. 6-9.

In one embodiment, the lateral surface begins at the distal aspect of the wall shoulder portion 221 and extends substantially parallel to the longitudinal axis of the container at least 25% of the longitudinal distance from the distal aspect to the injection site measured along the longitudinal axis of the container. In another embodiment, the lateral surface begins at the distal aspect of the wall shoulder portion and extends substantially parallel to the longitudinal axis of the container at least 50% of the longitudinal distance from the distal aspect to the injection site measured along the longitudinal axis of the container.

Figure 6:
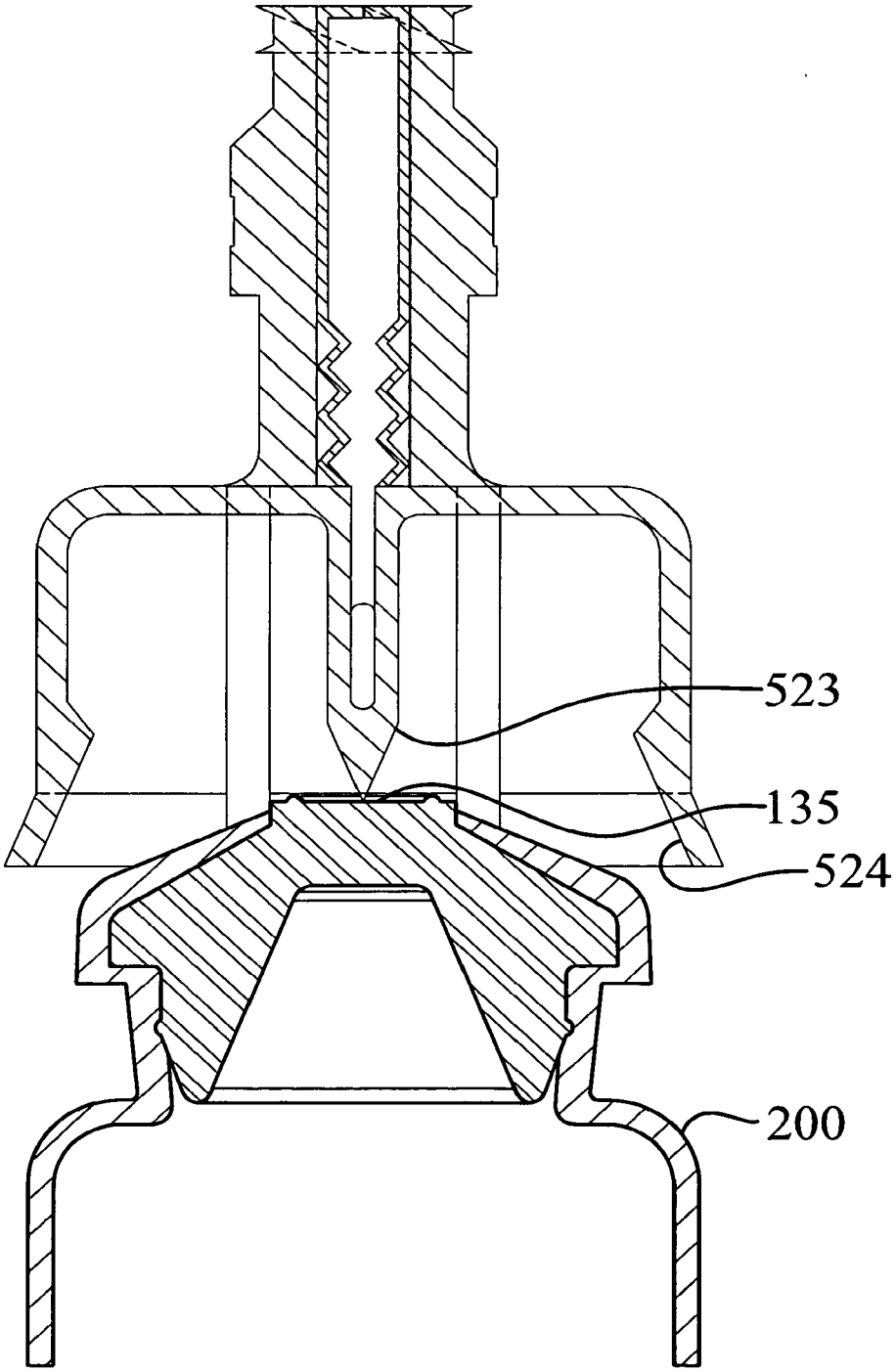
FIG. 6 is a cross section view of a part of the body portion of the embodiment of FIG. 5, and a needle-free connector.

The advantage of the at least one raised gusset design may be seen in FIGS. 6-9. In FIG. 6, a needle free connector 500, see FIG. 10*a*, of the type, by way of example only, of the SMARTSITE® needle-free connector poised at the moment of puncture of the injection site 135, see FIG. 6, of the raised nipple 130. One skilled in the art can see, as would be confirmed by reference to FIG. 7*a*, that it is relatively easy for an operator to place the needle-free connector 500 eccentrically on the container 10, potentially leading to an unstable connection and an improper puncturing of the injection surface 135.

Typical features of a needle-free connector 500 may be seen in FIGS. 10*a*-10*d*, as well as in FIGS. 6, 7*a*, and 8-9. As seen in FIGS. 8 and 10*a-d*, some of the features of a typical needle-free connector include a connector male end fluid port ingress regulator 523, essentially shaped as a spike-like means for puncturing the stopper 100 at the injection site 135 and a connector male end fluid port interlock 524, essentially configured as resilient clips that allow the needle-free connector 500 to cooperate with various configurations of the body portion 200 of the container 10.

The effect of the raised gusset 228 design, particularly embodiments employing a lateral surface 229 substantially parallel to the longitudinal axis of the container 10, may be appreciated by one skilled in the art as illustrated in FIG. 8. As the needle-free connector approaches the top of the container 10, the raised gusset(s) 228, particularly the lateral edges 229, interacts with the clip-like sides of the needle-free connector. This tends to guide the needle-free connector to a proper central placement on the injection site 135. Additionally, as can be seen in FIG. 9, the raised gusset(s) 228 tend to fill the interior volume of the needle-free connector and to insure a closer and more stable fit with the body portion 200 of the container 10. The details of a typical needle-free container suitable for use with the instant invention are shown, by way of example only, in FIGS. 10*a-d*.

Numerous alterations, modifications, and variations of the preferred embodiments disclosed herein will be apparent to those skilled in the art and they are all anticipated and contemplated to be within the spirit and scope of the claimed invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

In particular, while the container described above shares many features in common with embodiments of containers described in application '869, it is noted that the opener described herein is not limited to being used in conjunction with such embodiments, and that the opener can be used to open containers having other configurations.

What is claimed is:

1. A container for providing access to a raised nipple upon opening, the container having at least one diameter and a longitudinal axis, the container comprising:

a container shell comprising:

a body portion with a body portion wall having a wall shoulder portion having a distal aspect and a proximal aspect; and an adjoining cap portion having a cap portion wall, wherein the body portion wall meets the cap portion wall at an engineered separation site;

a stopper enclosed within the container shell and configured to prevent the transfer of contents from the body portion to the cap portion, such that a portion of the stopper is enclosed within the body portion and another portion of the stopper is enclosed within the cap portion, wherein the stopper has a stopper wall and a stopper shoulder with a central raised nipple having a nipple top surface with an injection site bounded by a raised injection guide and a nipple sidewall, and wherein the engineered separation site is adjacent to the nipple sidewall such that when the cap portion is removed from the body portion at the engineered separation site a portion of the nipple extends out of the body portion;

an opener having at least one tab that extends a fixed radial distance from the longitudinal axis along a first axis orthogonal to the longitudinal axis, the opener being attached to the container and configured to separate the cap portion from the body portion at the separation site by rotating about a second axis that is orthogonal to both the longitudinal axis and the first axis, such that application of a downwardly directed force to the cap portion parallel to the longitudinal axis, at a certain radial distance from the longitudinal axis and at a radially outer end of the tab, results in a torque being imparted about the second axis and breakage at the separation site wherein the torque is at least a predetermined torque; and a collar disposed at least around the wall shoulder portion.

2. The container according to claim 1, wherein the collar extends from a first opening surrounding the separation site to a second opening surrounding a neck formed in the body portion below an annular flange formed in the body portion.

3. The container according to claim 2, wherein the collar is configured to be removable.

4. The container according to claim 3, wherein the collar includes at least a pair of semicircular annular channels hingedly connected to each other at respective ends thereof, the channels having free ends configured to be connected together to close the collar around the wall shoulder portion.

5. The container according to claim 4, wherein the annular channels are configured to secure the collar to the body portion when the collar is closed around the wall shoulder portion.

6. The container according to claim 5, wherein each of the free ends of the pair of annular channels includes a corresponding mating connector configured to connect the free ends together.

7. The container according to claim 2, wherein the collar displays indicia related to the contents of the container.

8. The container according to claim 7, wherein the collar displays a color.

9. The container according to claim 2, wherein a portion of the collar is configured to act as a fulcrum for the at least one tab.

10. A fluid container including:

a body portion configured to at least partially surround fluid;

a cap portion having at least one tab that extends a fixed radial distance from a longitudinal axis of the fluid container, along a first axis orthogonal to the longitudinal axis, the opener being connected to and above the body portion at a frangible separation site surrounding an opening between the body portion and the cap portion, wherein the cap portion is configured to separate from the body portion at the separation site to expose the opening by rotating about a second axis that is orthogonal to both the longitudinal axis and the first axis, such that application of a downwardly directed force to a part of the cap portion at a certain radial distance from a longitudinal axis through the opening and at a radially outer end of the tab results in a torque being imparted about the second axis and breakage at the separation site; and a collar configured to be disposed at least around a wall shoulder portion, wherein the collar includes at least a pair of semicircular annular channels hingedly connected to each other at respective ends thereof, the channels having free ends configured to be connected together to close the collar around the wall shoulder portion.

11. The container according to claim 10, wherein the collar extends from a first opening surrounding the separation site to a second opening surrounding a neck formed in the body portion below an annular flange formed in the body portion.

12. The container according to claim 11, wherein the collar is configured to be removable.

13. The container according to claim 10, wherein the annular channels are configured to secure the collar to the body portion when the collar is closed around the wall shoulder portion.

14. The container according to claim 13, wherein each of the free ends of the pair of annular channels includes a corresponding mating connector configured to connect the free ends together.

15. The container according to claim 10, wherein the collar displays indicia related to the contents of the container.

16. The container according to claim 15, wherein the collar displays a color.

17. The container according to claim 10, wherein a portion of the collar is configured to act as a fulcrum for the at least one tab.

18. A container for providing access to a raised nipple upon opening, the container having at least one diameter and a longitudinal axis, the container comprising:

a container shell comprising:

a body portion with a body portion wall having a wall shoulder portion having a distal aspect and a proximal aspect, wherein the body portion wall includes an ingress preventer; and an adjoining cap portion having a cap portion wall, wherein the body portion wall meets the cap portion wall at an engineered separation site;

a stopper enclosed within the container shell and configured to prevent the transfer of contents from the body portion to the cap portion, such that a portion of the stopper is enclosed within the body portion and another portion of the stopper is enclosed within the cap portion, wherein the stopper has a stopper wall and a stopper shoulder with a central raised nipple having a nipple top surface with an injection site bounded by a raised injection guide and a nipple sidewall, and wherein the engineered separation site is adjacent to the nipple sidewall such that when the cap portion is removed from the body portion at the engineered separation site a portion of the nipple extends out of the body portion;

an opener having at least one tab that extends a fixed radial distance from the longitudinal axis along a first axis orthogonal to the longitudinal axis, the opener being attached to the container and configured to separate the cap portion from the body portion at the separation site by rotating about a second axis that is orthogonal to both the longitudinal axis and the first axis, such that application of a downwardly directed force to the cap portion parallel to the longitudinal axis, at a certain radial distance from the longitudinal axis and at a radially outer end of the tab, results in a torque being imparted about the second axis and breakage at the separation site; and a collar disposed at least around the wall shoulder portion, wherein the collar has a first annular surface, a second annular surface, a third annular surface and a fourth annular surface, wherein the first annular surface is substantially parallel to the fourth annular surface and wherein the third annular surface extends downward toward a flange formed by the ingress preventer.

* * * * *